US005342743A

United States Patent [19]

Goto et al.

[11] Patent Number: 5,342,743

[45] Date of Patent: * Aug. 30, 1994

[54] SILVER HALIDE PHOTOGRAPHIC MATERIAL

[75] Inventors: Takahiro Goto; Nobuaki Inoue, both of Kanagawa, Japan

[73] Assignee: Fuji Photo Film Co., Ltd., Kanagawa, Japan

[ * ] Notice: The portion of the term of this patent subsequent to Mar. 29, 2011 has been disclaimed.

[21] Appl. No.: 906,472

[22] Filed: Jun. 30, 1992

[30] Foreign Application Priority Data

Jul. 1, 1991 [JP] Japan ..... 3-185773
Jul. 4, 1991 [JP] Japan ..... 3-189594

[51] Int. Cl.[5] ..... G03C 1/09; G03C 1/83

[52] U.S. Cl. ..... 430/507; 430/496; 430/510; 430/513; 430/517; 430/522; 430/567; 430/604

[58] Field of Search ..... 430/567, 522, 510, 513, 430/496, 604, 517, 507

[56] References Cited

U.S. PATENT DOCUMENTS 4,563,406 1/1986 Ohbayashi et al. ..... 430/513
4,988,611 1/1991 Anderson et al. ..... 430/494
5,045,444 9/1991 Bahnmüller et al. ..... 430/567

FOREIGN PATENT DOCUMENTS

WO8804794 6/1988 PCT Int'l Appl. .

*Primary Examiner*—Thorl Chea
*Attorney, Agent, or Firm*—Sughrue, Mion, Zinn, Macpeak & Seas

[57] ABSTRACT

There is disclosed a silver halide photographic material which can satisfy the specific properties required for dot to dot work photographic materials and can be handled under an environment of a bright room. The silver halide photographic material comprises a support, having provided thereon at least one light-sensitive silver halide emulsion layer and having provided farther from the support than the emulsion layer a light-insensitive hydrophilic colloid layer. The light-insensitive hydrophilic colloid layer contains at least a solid dye which is dispersed in the form of fine particles and further may contain a water soluble dye. The silver halide grains contained in the light-sensitive emulsion layer have an average grain size of 0.15 μm or less and contain therein at least $1\times10^{-7}$ mole per mole of a silver of transition metal selected from the elements of groups V to VIII of the Periodic Table.

5 Claims, No Drawings

SILVER HALIDE PHOTOGRAPHIC MATERIAL

FIELD OF THE INVENTION

The present invention relates to a silver halide photographic material, more specifically to a silver halide photographic material capable of being handled under an environment which can be referred to a substantially bright room.

BACKGROUND OF THE INVENTION

In the printing and copying fields, improvement in the working capacity of photographic plate making steps is required. Particularly in the page make-up and dot to dot work stages, an improvement in working capacity has been attempted by an operation under a brighter environment. For this purpose there have been promoted development of a silver halide photographic material for a plate making, which can be handled under an environment which could be called a bright room, and development of an exposure printer.

A silver halide photographic material for a bright room used in the present invention means a photographic material in which a light having a wavelength of 400 nm or more and containing no ultraviolet component can be used as a safelight.

For the purpose of increasing safety against the above safelight, dyes which are capable of absorbing a visible ray have been incorporated into a hydrophilic colloid layer existing farther from a support than the light-sensitive silver halide emulsion layer. When these dyes act as a filter layer, it is necessary that the layer in question is selectively colored and that the other layers are substantially not colored. If the emulsion layers are substantially colored as well, not only disadvantageous photographic effects are given to the emulsion layers but also the effect of the filter layer is reduced. In particular, there are problems such as deterioration of the spreading and chalking properties, which is specific to the dot to dot work field, reduction in tone versatility and reduction of an outline type property.

There has been hitherto known as a solution to these problems, a method of localizing a so-called acidic dye having a sulfo group and a carboxyl group in a specific layer with a mordant. Such mordants include the polymers of ethylenically unsaturated compounds having a dialkylaminoalkyl ester residue, described in British Patent 685,475; the reaction products of poly-vinylalkyl ketone and aminoguanidine described in British Patent 850,281; and vinylpyridine polymers and vinylpyridinium cationic polymers described in U.S. Pat. Nos. 2,548,564, 2,484,430, 3,148,061, and 3,756,814. In these patents, the cationic mordants having a secondary or tertiary amino group, a nitrogen-containing heterocyclic group and a quaternary cationic group thereof in the polymers are used so that the above acidic dyes can be efficiently mordanted.

In these mordands, it is often observed that the above acidic dyes diffuse to the other layers. In order to prevent the diffusion, one might consider using a lot of the mordants. However, not only can the diffusion not be completely prevented, but also the thickness of the layers into which the mordants are to be incorporated is increased, which in turn has resulted in generating new problems.

Further, in a light-sensitive material for printing plate-making, the procedure of cutting reduction, in which a reducer is used, is usually carried out. A water soluble iron complex is contained as a reduction cutting agent in the reducer, and the use of the above cationic mordants generates the disadvantage that they electrostatistically combine with this iron complex to yield yellow stain by the iron complex.

Further, the other known means for fixing the dyes in a specific layer of a photographic material is to add the dyes as a dispersed solid as disclosed in JP-A-56-12639 (the term "JP-A" as used herein means an unexamined published Japanese patent application), JP-A-55-155350, JP-A-55-155351, JP-A-52-92716, JP-A-59-193447, JP-A-61-198148, JP-A-63-197943, JP-A-63-27838, and JP-A-64-40827, European Patent 0015601B1 and European Patent 0276566A1, and International Patent WO 88/04794. However, it is not known how to combine silver halide ultra fine grain therewith to increase Dm and satisfy the properties which are specific to the dot to dot work field. Also, it has been impossible to completely attain the tone reproducibility required for a dot to dot work light-sensitive material.

SUMMARY OF THE INVENTION

Accordingly, an object of the present invention is to provide a silver halide photographic material which can satisfy the specific properties required for a dot to dot work light-sensitive material (that is, tone reproducibility, tone versatility, spreading and chalking properties, and an outline type property), which can provide a higher density of solid portion when subjected to an under-exposure in controlling the tone of a halftone image, and which can be handled under the environment of a bright room.

This and other objects of the present invention have been achieved by a silver halide photographic material comprising a support, having provided thereon at least one light-sensitive silver halide emulsion layer, and having provided thereon farther from the support than the emulsion layer a light-insensitive hydrophilic colloid layer comprising a solid dye which is dispersed in the form of fine particles which may further contain a water soluble dye, wherein the silver halide grains contained in the light-sensitive emulsion layer have an average grain size of 0.15 Bm or less and contain therein at least $1\times10^{-7}$ mole per mole of silver of a transition metal selected from the elements of groups V to VIII of the Periodic Table.

DETAILED DESCRIPTION OF THE INVENTION

The compounds described in Tables I to X of International Patent W088/04794, the compounds represented by following Formulas (I) to (VII), and other compounds can be used as the dyes capable of being dispersed in the form of a fine crystal solid in the present invention:

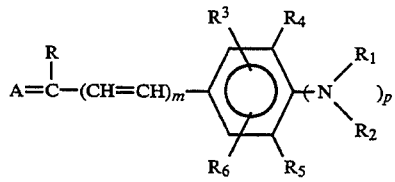

(I)

-continued

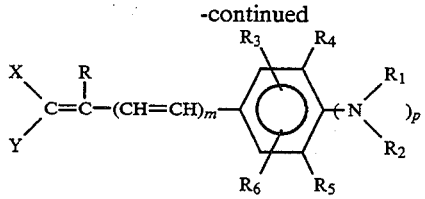

(II)

$$A{=}L_1{-}(L_2{=}L_3)_n{-}A' \quad \text{(III)}$$

$$A{=}(L_1{-}L_2)_{2-q}{=}B \quad \text{(IV)}$$

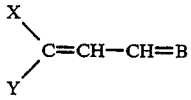

(V)

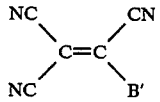

(VI)

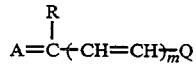

(VII)

wherein A and A′ may be the same or different and each represents an acidic nucleus; B represents a basic nucleus; X and Y may be the same or different and each represents an electron attractive group; R represents a hydrogen atom or an alkyl group; $R_1$ and $R_2$ each represents an alkyl group, an aryl group, an acyl group, or a sulfonyl group, provided that $R_1$ and $R_2$ may be combined with each other to form a 5- or 6-membered ring; $R_3$ and $R_6$ each represents a hydrogen atom, a hydroxy group, a carboxyl group, an alkyl group, an alkoxy group, or a halogen atom; $R_4$ and $R_5$ each represents a hydrogen atom or the group of non-metal atoms necessary for forming a 5- or 6membered ring by combining $R_1$ and $R_4$ or $R_2$ and $R_5$; $L_1$, $L_2$ and $L_3$ each represents a methine group; m represents 0 or 1; n and q each represents 0, 1 and 2; p represents 0 or 1, provided that when p is 0, $R_3$ presents a hydroxy group or a carboxyl group and both $R_4$ and $R_3$ represent a hydrogen atom; B′ represents a carboxyl group, a sulfamoyl group, or a heterocyclic group having a sulfonamide group; and Q represents a heterocyclic group.

The compounds represented by Formulas ( I ) to (VII) have in one molecule at least one dissociative group having a pKa value of 4 to 11 in a mixed solution having water and ethanol ratio ( by volume ) of 1: 1.

To be concrete, the dyes. dispersed in the form of a solid include the compounds described in International Patent NO.88/04794, European Patents EP 0274723A1, 276,566, and 299,435, JP-A-52-92716, JP-A-55-155350, JP-A-55-155351, JP-A61-205934, and JP-A-48-68623, U.S. Pat. Nos. 2,527,583, 3,486,897, 3,746,539, 3,933,798, 4,130,429, and 4,040,841, JP-A-3-7931, JP-A-2-282244, and JP-A-3-167546.

The dispersing methods also are described in the above patents and include the method in which the dyes are mechanically dispersed in the form of a solid in water together with a suitable dispersant by a ball mill, a sand mill or a colloid mill; the method in which the dyes are dispersed in the form of a solid by applying the salts of the dissociated dyes, followed by further applying an acidic gelatin thereon, to thereby obtain a dispersed solid in coating; the method in which the dyes are dissolved in an alkaline solution and then the pH of the solution is lowered in the presence of a protective colloid such as gelatin to thereby obtain fine solid precipitates. Further, it is also possible to obtain a dispersed solid of a dye by dissolving the dye in a suitable solvent and then adding thereto a solvent which scarcely dissolves the dye.

The preferable dyes in the present invention have a maximum absorption in the range of 300 to 500 nm. Examples of the dyes are shown below, but are not limited thereto:

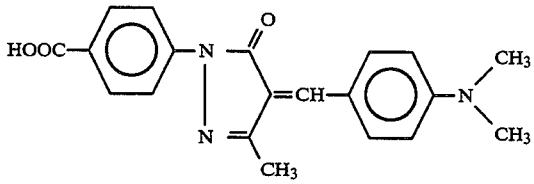

I-1

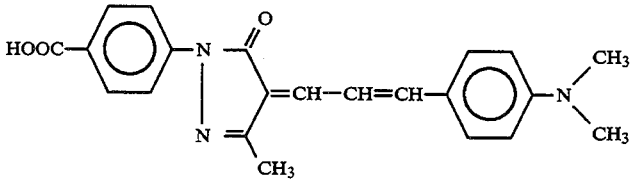

I-2

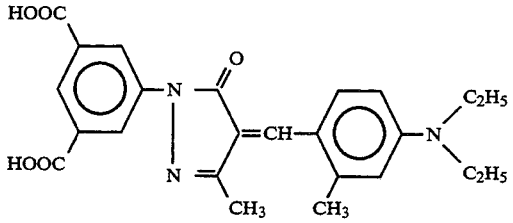

I-3

-continued
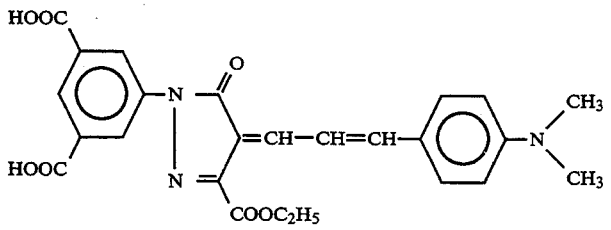
I-4
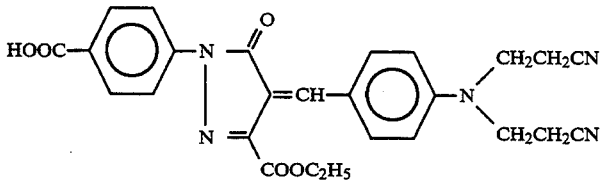
I-5
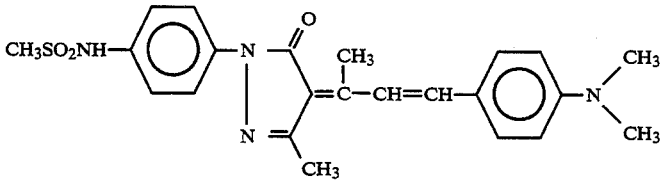
I-6
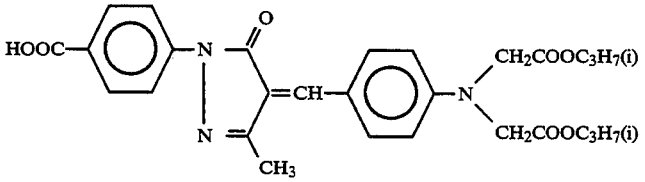
I-7
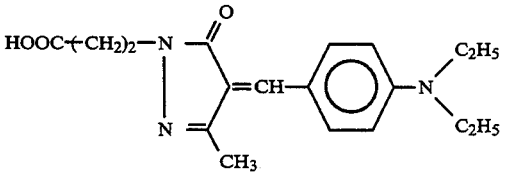
I-8
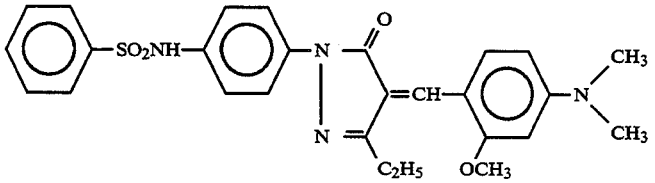
I-9
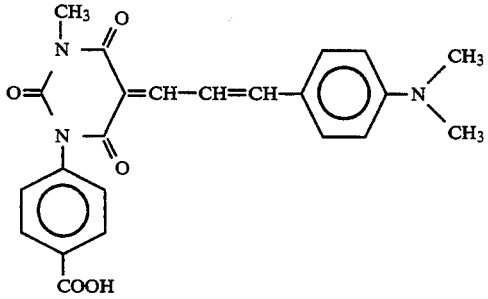
I-10
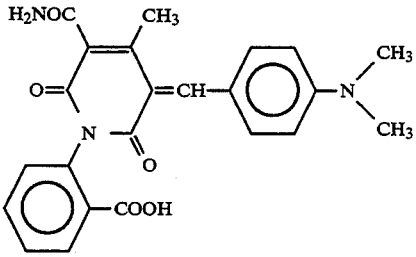
I-11

-continued
I-12
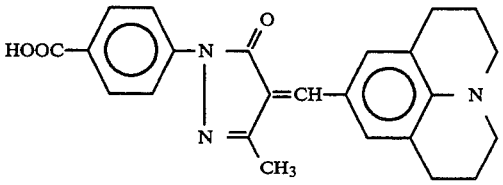
I-13
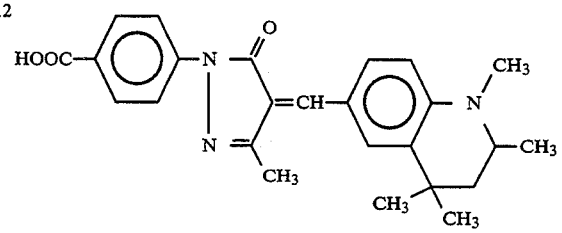
I-14
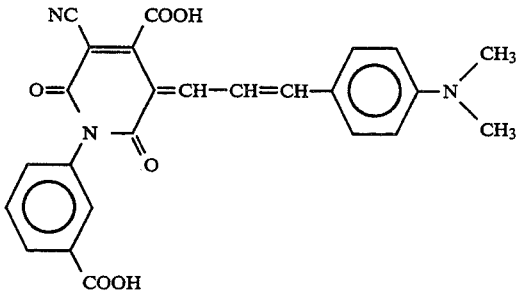
I-15
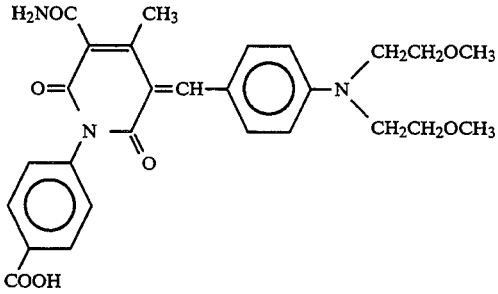
I-16
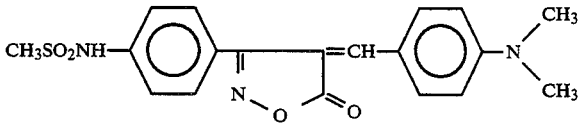
I-17
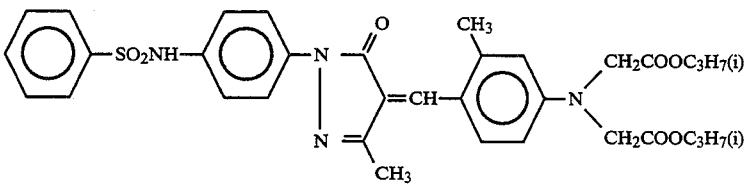
I-18
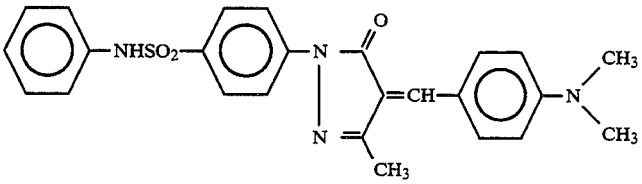
I-19
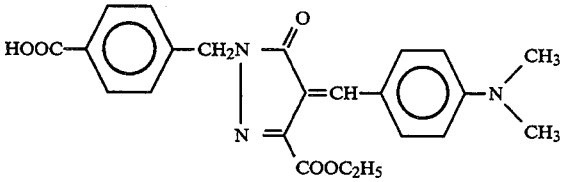
I-20
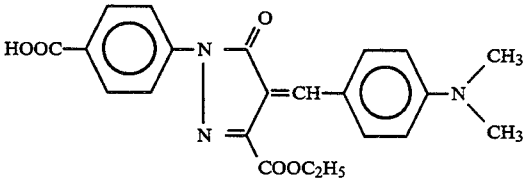
II-1
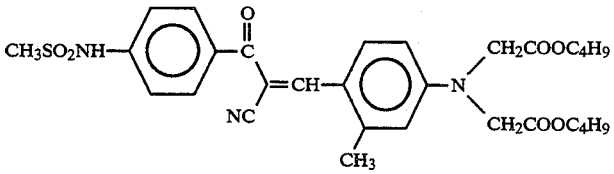

-continued
II-2
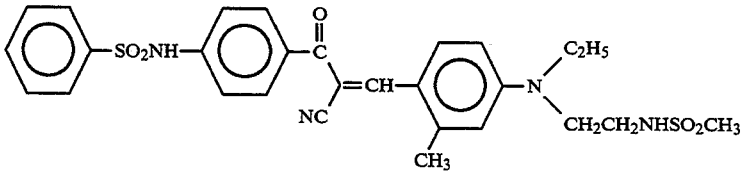
II-3
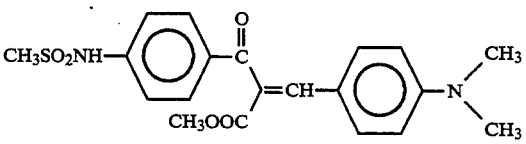
II-4
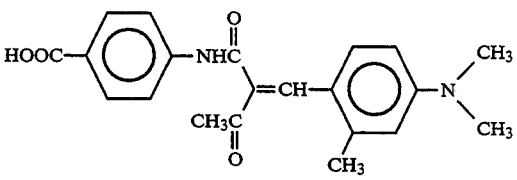
II-5
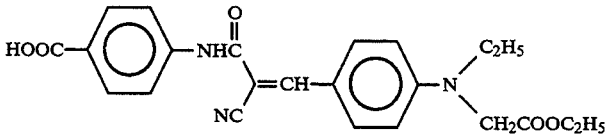
II-6
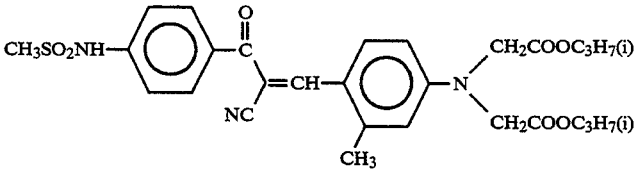
III-1
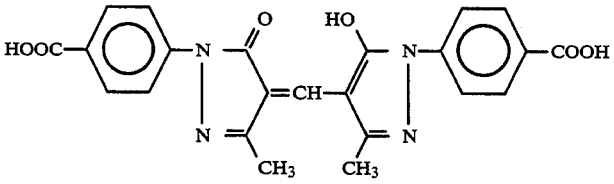
III-2
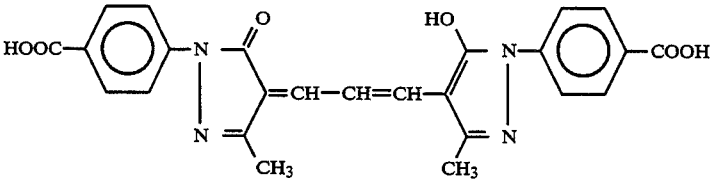
III-3
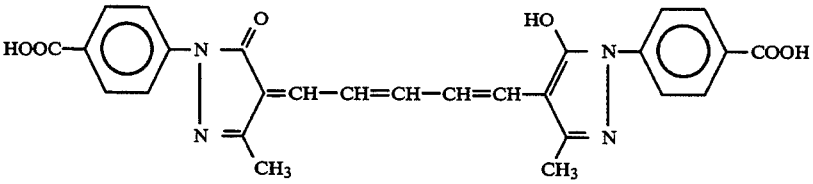
III-4
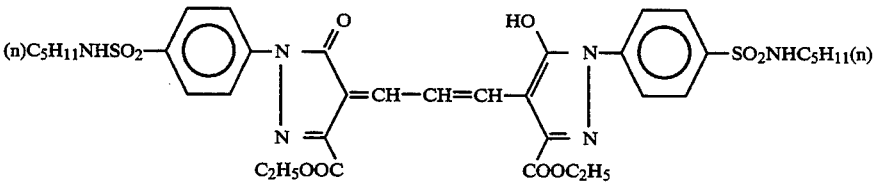

-continued
III-5
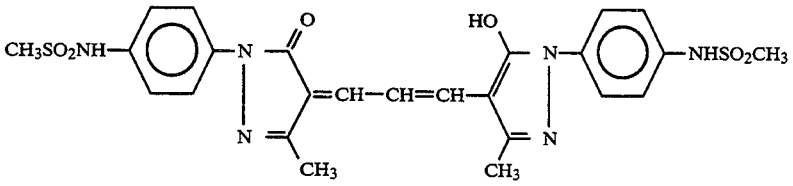
III-6
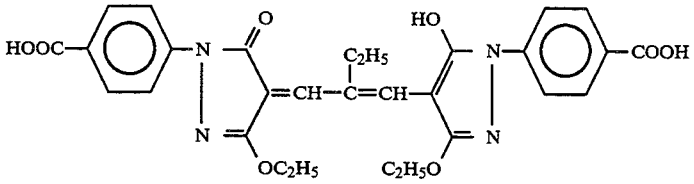
III-7
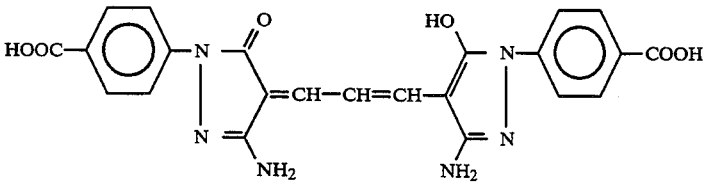
III-8
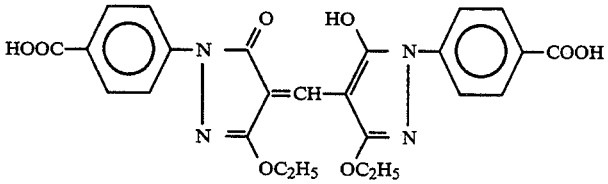
III-9
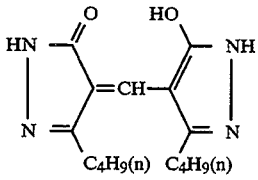
III-10
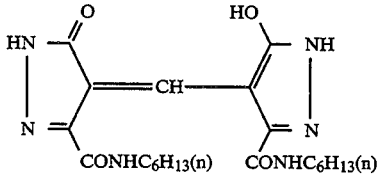
IV-1
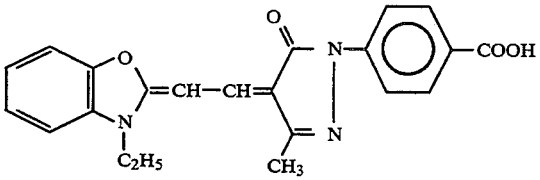
IV-2
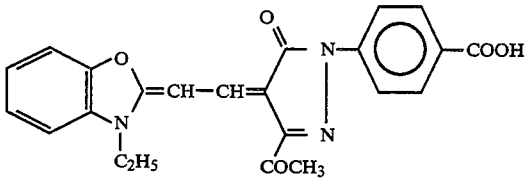
IV-3
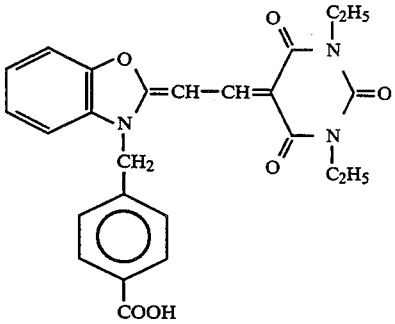

-continued
IV-4
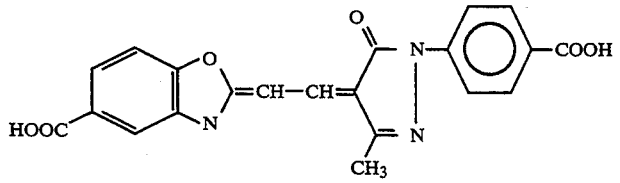
IV-5
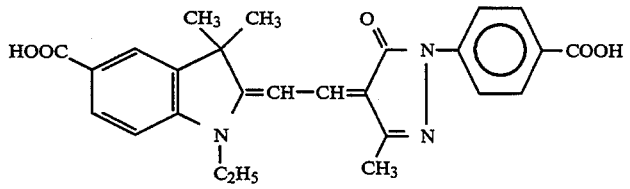
IV-6
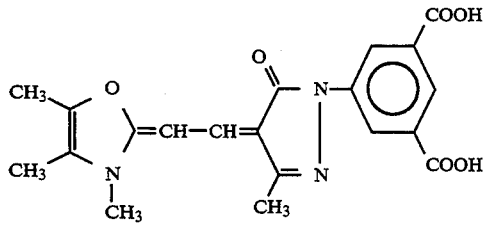
IV-7
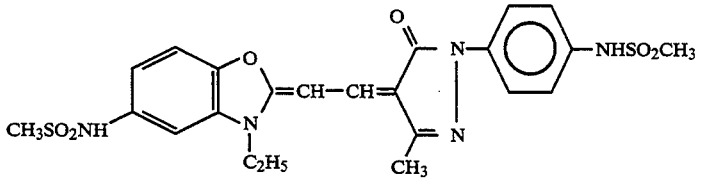
IV-8
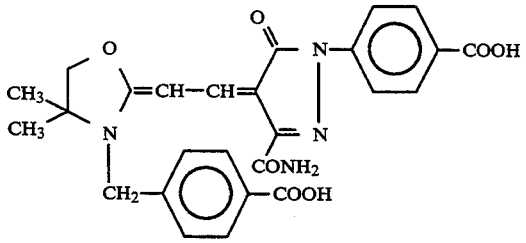
IV-9
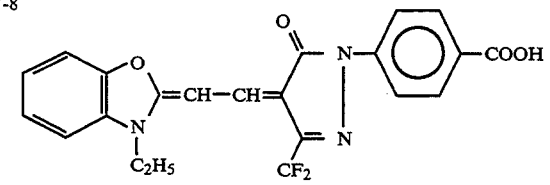
V-1
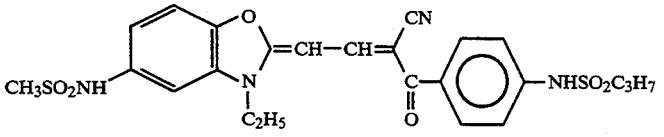
V-2
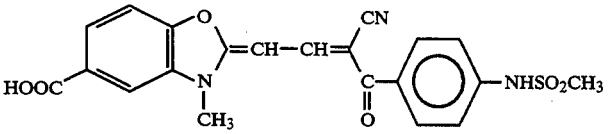
V-3
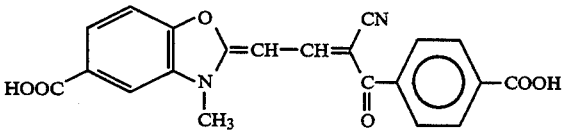

-continued
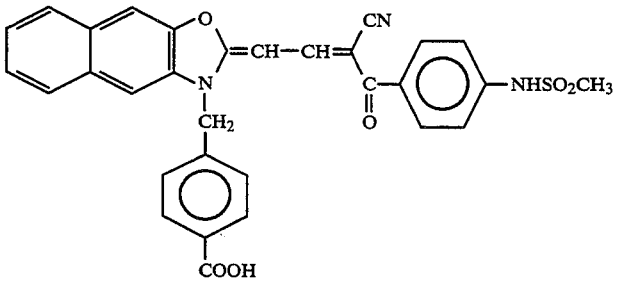
V-4
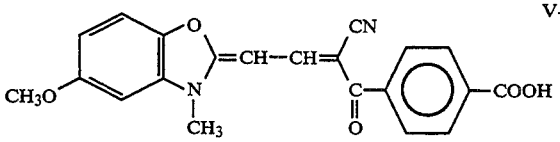
V-5
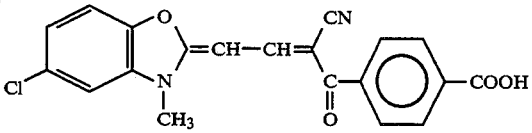
V-6
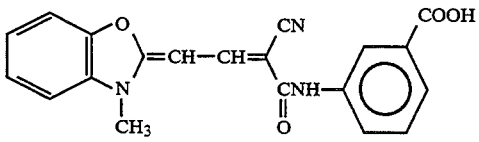
V-7
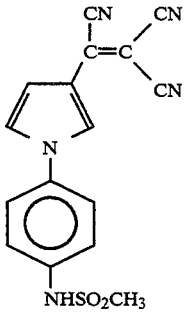
VI-1
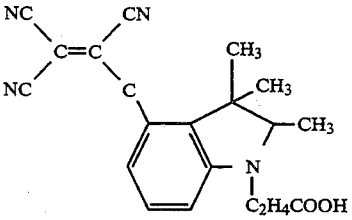
VI-2
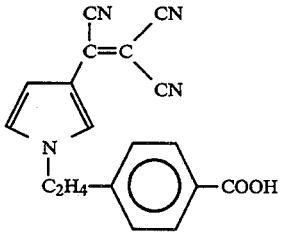
VI-3
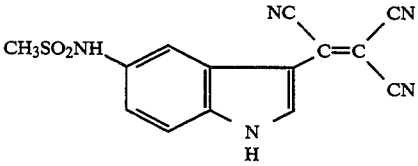
VI-4
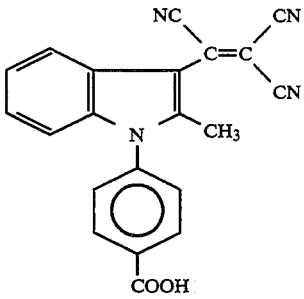
VI-5
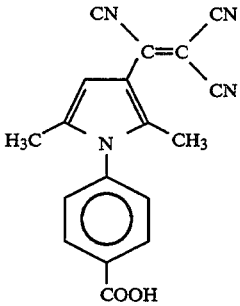
VI-6
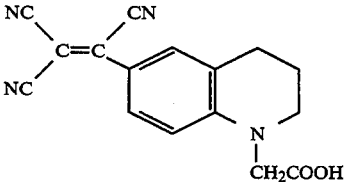
VI-7

-continued

VI-8

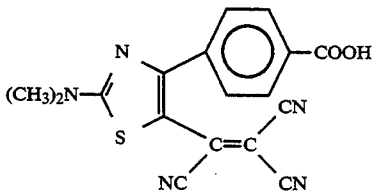

VII-1

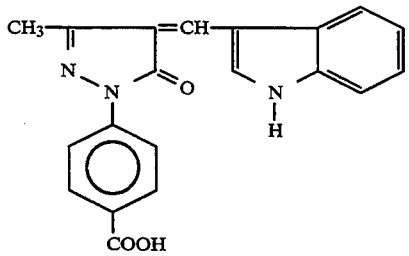

VII-2

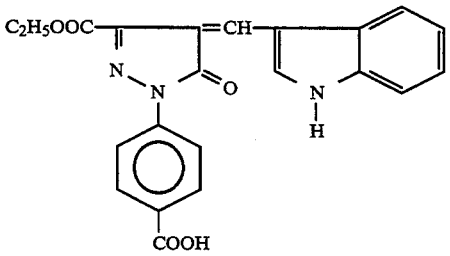

VII-3

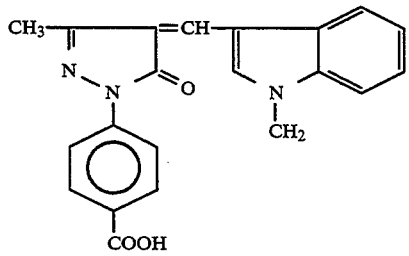

VII-4

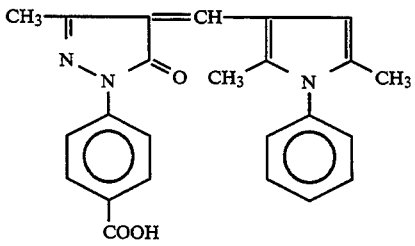

VII-5

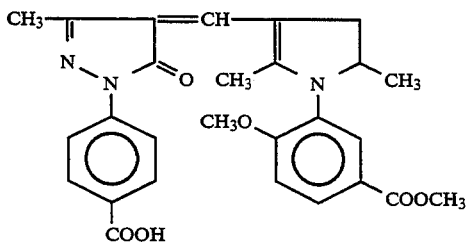

VII-6

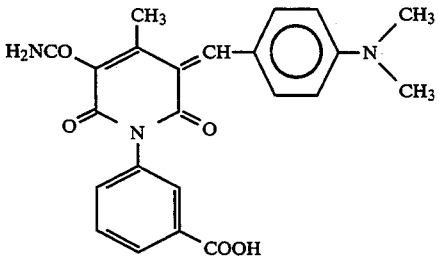

VII-7

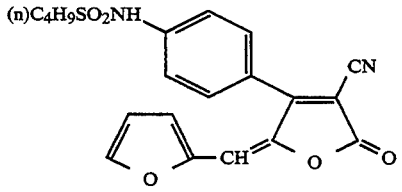

The silver halide photographic materials containing the dyes dispersed in the form of a fine crystal solid of the present invention can be handled in a bright room from which UV rays are cut off. The dyes can be added to a light-insensitive hydrophilic colloid layer farther from the support than the emulsion layer for the purpose of improving the spreading, chalking and outline type properties of the material. The coated amount of the dyes is preferably 10 to 500 mg, particularly preferably 50 to 300 mg/m$^2$, of the light-sensitive material.

The dyes used in the present invention can be readily synthesized according to the methods described in International Patent W088/04794, European Patents EP 0274723A1, 276,566, and 299,435, JP-A-52-92716, JP-A-55-155350, JP-A-55-155351, JP-A-61-205934, and JP-A-48-68623, U.S. Pat. Nos. 2,527,583, 3,486,897, 3,746,539, 3,933,798, 4,130,429, and 4,040,841, JP-A-2-282244, JP-A-3-7931 and JP-A-3-167546.

Further, the silver halide photographic material of the present invention preferably contains the water-soluble dyes and/or dyes dispersed in the form of a fine crystal solid at least in a light-sensitive silver halide emulsion layer within the range in which the spreading and chalking properties, an outline type property and a tone versatility are not deteriorated. That range is one in which the sensitivity reduction does not exceed 0.20 in terms of log E. In case of the water-soluble dyes, they may also be added to a hydrophilic colloid layer (i.e., a light-insensitive hydrophilic colloid layer) other than an emulsion layer to make them diffuse into the emulsion layer in the same amount as described below. These dyes are added for the purpose of improving a tone reproducibility. They can be preferably added to the light-sensitive (silver halide) emulsion layer in an amount in the range of preferably 5 to 100 mg/m$^2$ and more preferably 10 to 50 mg/m$^2$.

The water soluble dyes used in the present invention have main absorptions in the visible wavelength region of the intrinsic light-sensitive wavelength of the silver halide emulsion used. Among them, preferred are the dyes having λmax of from 350 to 600 nm. The chemical structures of the dyes are not specifically limited, and an oxonol dye, a hemioxonol dye, a merocyanine dye, a cyanine dye, and an azo dye can be used.

To be concrete, one can use, for example, the pyrazolone dyes described in JP-B-58-12576 (the term "JP-B" as used herein means an examined Japanese patent publication), the pyrazolone oxonol dyes described in U.S. Pat. No. 2,274,782, the diarylazo dyes described in U.S.

Pat. No. 2,956,879, the styryl dyes and butadienyl dyes described in U.S, Pat. Nos. 3,423,207 and 3,384,487, the merocyanine dyes described in U.S. Pat. No. 2,527,583, the merocyanine dyes and oxonol dyes described in U.S. Pat. Nos. 3,486,897, 3,652,284, and 3,718,472, the enaminohemioxonol dyes described in U.S. Patent 3,976,661, and the dyes described in British Patents 584,609 and 1,177,429, JP-A-48-85130, JP-A-49-99620, and JP-A-49-114420, U.S. Pat. Nos. 2,533,472, 3,148,187, 3,177,078, 3,247,127, 3,540,887, 3,575,704, and 3,653,905.

The silver halide emulsion contained in the silver halide photographic material used in the present invention comprises the silver halide grains having an average grain size of 0.15 μm or less, preferably 0.08 to 0.13 μm. Grains larger than 0.15 μm have a smaller covering power and are insufficient for obtaining high Dmax with a low amount of silver. Meanwhile, grains smaller than 0.08 μm make it difficult to provide an emulsion with an excellent monodispersion.

In preparing the silver halide grains in the present invention, the following mixing conditions will lead to the good results: a reaction temperature of generally 50° C. or lower, preferably 40° C. or lower; a silver potential of generally 70 mV or higher, preferably 300 to 500 mV under the condition of a high agitating speed sufficient for uniformly mixing, or 80 to 120 mV in the presence of a stabilizer such as 5,6-cyclopentane-4-hydroxy-1,3,3a,7-tetrazaindene.

Grain size distribution is fundamentally not limited. It is preferably a monodispersion, wherein the monodispersion is defined as an emulsion comprising grains that at least 95% by weight or grain number fall within the range of ±40%, preferably ±20% of the average grain size.

The silver halide grains used in the present invention have preferably a regular crystal form such as cube and octahedron, particularly preferably cube.

A transition metal coordination complex is preferred as the transition metal in the present invention and is a hexaligand complex represented by the following formula:

$$[M(NY)_mL_{6-m}]^n$$

wherein M is a transition metal selected from the elements of groups V to VIII of the Periodic Table; L is a bridging ligand; Y is oxygen or sulfur; m is 0, 1 or 2; and n is 0, −1, −2 or −3.

Preferred concrete examples of L include a halide ligand (fluoride, chloride, bromide and iodide), a cyanide ligand, a cyanate ligand, a thiocyanate ligand, a selenocyanate ligand, a tellocyanate ligand, an azide ligand, and an aquo ligand. Where the aquo ligand is present, one or two of the ligands are occupied preferably thereby.

The particularly preferred examples of M include rhodium, ruthenium, rhenium, osmium, and iridium.

Examples of the transition metal coordination complex are shown below:

1. $[Rh(H_2O)Cl_5]^{-2}$
2. $[RuCl_6]^{-3}$
3. $[Ru(NO)Cl_5]^{-2}$
4. $[Rh(Cl_6)]-3$
5. $[Ru(H_2O)Cl_5]^{-2}$
6. $[Ru(NO)(H_2O)Cl_4]^{-1}$
7. $[Re(NO)Cl_5]^{-2}$
8. $[Os(NO)Cl_5]^{-2}$
9. $[Ir(NO)Cl_5]^{-2}$
10. $[Ir(H_2O)Cl_5]^{-2}$
11. $[Re(H_2O)Cl_5]^{-2}$
12. $[RhBr_6]^{-2}$
13. $[Os(NS)Cl(SCN)_4]^{-2}$
14. $[ReCl_6]^{31\ 3}$
15. $[INCl_6]^{-3}$
16. $[Re(NS)Cl_4(SeCN)]^{-2}$

The above metal complexes can be added to silver halide grains during the preparation of the grains to incorporate the complexes into the grains.

The silver halide grains used in the present invention have a transition metal content of at least $1\times10^{7}$ mole, preferably $1\times10^{-6}$ to $5\times10^{31\ 4}$, particularly preferably $5\times10^{-6}$ to $2\times10^{-4}$ per mole of silver. The above transition metals may be used in combination thereof.

The distribution of the transition metal in the silver halide grains is not specifically limited. They are preferably distributed more on the outside of the grains.

The silver halide emulsion contained in the silver halide photographic material used in the present invention preferably comprise silver bromochloride or silver bromochloroiodide having a silver chloride content of 70% or more. An increase in the amount of silver bromide or silver iodide is not preferred since safelight safety in a bright room deteriorates or γ is lowered.

The silver halide emulsion used in the present invention may or may not be subjected to a chemical sensitization. A sulfur sensitizing method, a reduction sensitizing method and a noble metal sensitizing method are known as methods for chemically sensitizing a silver halide emulsion. Any of these may be used singly or in combination to provide chemical sensitization.

Among the noble metal sensitizing methods, a gold sensitizing method is typical, in which a gold compound, primarily a gold complex salt is used. There may be contained the complex salts of the noble metals other than gold, for example, platinum, palladium and iridium. The concrete examples thereof are described in U.S. Pat. No. 2,448,060 and British Patent 618,061.

There can be used as a sulfur sensitizer various sulfur compounds, for example, thiosulfates, thioureas, thiazoles and rhodanines as well as the sulfur compounds contained in gelatin.

There can be used as a reduction sensitizer stannous salts, amines, formamidinesulfinic acid, and silane compounds.

An inorganic or organic hardener may be incorporated into the photographic emulsion or light-insensitive, hydrophilic colloid.

There can be used singly or in combination, for example, active vinyl compounds (e.g., 1,3,5-triacryloylhexahydro-s-triazine, bis(vinylsulfonyl) methyl ether, and N,N-methylene-bis-[β-(vinylsulfonyl) propionamide]), active halogen compounds (e.g., 2,4-dichloro-6-hydroxy-s-triazine), mucohalogen acids (e.g., mucochloric acid), N-carbamoylpyridinium salts[e.g.,(1-morpholicarbonyl-3-pyridino)methanesulfonate], and haloamidinium salts [e.g., 1-(1-chloro-l-pyridinomethylene) pyrrolidiniumand 2-naphthalenesulfonate]. Of them, preferred are the active vinyl compounds described in JP-A-53-41220, JP- A-53-57257, JP-A-59-162546, and JP-A-60-80846, and the active halogen compounds described in U.S. Pat. No. 3,325,287.

The photographic emulsion layers and other hydrophilic colloid layers of the light-sensitive material prepared according to the present invention may contain various surface active agents for various purposes as coating aids, as antistatic agent, for improving the sliding property, for improving emulsification-dispersion, for preventing adhesion, and for improving photographic characteristics (for example, development acceleration, increase in contrast and increase in sensitivity).

The examples thereof include nonionic surface active agents such as saponin (a steroid type), alkylene oxide derivatives (for example, polyethylene glycol, a polyethylene glycol/polypropyrene glycol condensation product, polyethylene glycol alkylethers, polyethylene glycol alkyl aryl ethers, polyethylene glycol esters, polyethylene glycol sorbitan esters, polyethylene glycol alkylamines or amides, and adducts of silicon and polyethylene oxide), glycidol derivatives (for example, alkenylsuccinic acid polyglycerides and alkylphenol polyglycerides), fatty acid esters of polyhydric alcohol, and alkyl esters of sucrose; anionic surfactants having acid groups including a carboxy salt group, a sulfo salt group, a phospho salt group, a sulfuric acid ester group and a phosphoric acid ester group, such as an alkylcarbonic acid salt, an alkylsulfonic acid salt, an alkylbezenesulfonic acid salt, an alkylnaphtalenesulfonic acid salt, alkylsulfuric acid esters, alkylphosphoric acid esters, N-acyl-N-alkyltaurines, sulfosuccinic acid esters, sulfoalkyl polyoxyethylenealkylphenyl ethers, and polyoxyethylene alkylphosphoric acid esters; amphoteric surfactants such as amino acids, aminoalkylsulfonic acid, aminoalkylsulfonic acid or aminoalkylphosphoric acid esters, alkylbetains, and amine oxides; and cationic surfactants such as alkylamine salts, aliphatic or aromatic quaternary ammonium salt, pyridinium, heterocyclic quaternary ammonium salts such as imidazolium, and aliphatic or heterocycle-containing phosphonium or sulfonium salts.

Further, the fluorinated surface active agents described in JP-A-60-80849 are preferably used as an antistatic agent.

In the photographic material of the present invention, a matting agent such as silica, magnesium oxide and polymethyl methacrylate can be incorporated into the photographic emulsion layer or other hydrophilic colloid layers for the purpose of preventing adhesion.

The photographic material of the present invention can contain dispersions of water insoluble or sparingly water soluble synthetic polymers for the purpose of improving a dimension stability. For example, there can be used singly or in combination, the polymers of alkyl methacrylate, alkoxyalkyl methacrylate, and glycidyl methacrylate, and the polymers the monomer components of which are combinations of the above monomers, acrylic acid and methacrylic acid.

Gelatin is favorably used as a binder or protective colloid for a photographic emulsion. In addition to gelatin, the other hydrophilic colloids can be used as well. There can be used, for example, proteins such as a gelatin derivative, a graft polymer of gelatin and other polymers, albumin and casein; cellulose derivatives such as hydroxyethylcellulose, carboxymethylcellulose and cellulose sulfuric acid esters; sucrose derivatives such as sodium alginate and a starch derivative; and various synthetic hydrophilic polymers such as homopolymers and copolymers of vinyl alcohol, partially-acetalized vinyl alcohol, poly-N-vinylpyrrolidone, acrylic acid, polymethacrylic acid, polyacrylamide, polyvinylimidazole, and polyvinylpyrazole. There can be used as gelatin, an acid-treated gelatin as well as lime-treated gelatin. A gelatin hydrolysis product and a gelatin enzyme-decomposed product can be used as well.

A polymer latex such as polyalkyl acrylate can be incorporated into a silver halide emulsion layer used in the present invention.

There can be used as a support for the light-sensitive material, cellulose triacetate, cellulose diacetate, nitrocellulose, polystyrene, polyethylene terephthalate paper, baryta coated paper, and polyolefin coated paper.

The developing agents in the developing solution used in the present invention are not specifically limited. Dihydroxybenzenes are preferably contained therein from the viewpoint of ease in obtaining an excellent halftone dot quality. There are used in some cases, a combination of dihydroxybenzenes and 1-phenyl-3-pyrazolidones, or a combination of dihydroxybenzenes and p-aminophenols.

There can be given as the dihydroxybenzene developing agent used in the present invention, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Of them, hydroquinone is particularly preferred.

Examples of the developing agent which is 1-phenyl-3pyrazolidone or the derivatives thereof include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Examples of the p-aminophenol developing agent include N-methyl-p-aminophenol, p-aminophenol, N-($\beta$-hydroxyethyl)-p-aminophenol, N-(4-hydroxyphenyl) glycine, 2-methyl-p-aminophenol, and p-benzyl aminophenol. Among these, N-methyl-p-aminophenol is preferred.

Usually, the developing agent is used preferably in an amount of 0.05 to 0.8 mol/liter. Where the combination of dihydroxybenzenes and 1-phenyl-3-pyrazolidones or p-aminophenols is used, the former is used preferably in an amount of 0.05 to 0.5 mol/liter and the latter in an amount of 0.06 mol/ liter or less.

The sulfite preservative used in the present invention may be sodium sulfite, potassium sulfite, lithium sulfite, ammonium sulfite, sodium bisulfite, potassium metabisulfite, and formaldehyde sodium bisulfite. The sulfite is used preferably in an amount of 0.3 mol/liter or more, particularly preferably 0.4 mol/liter or more. The upper limit is preferably 2.5 mol/liter, particularly preferably 1.2 mol/liter.

The alkali agent used for controlling pH may be a pH adjusting agent and a buffering agent such as sodium hydroxide, potassium hydroxide, sodium carbonate, potassium carbonate, sodium tertiary phosphate, potassium tertiary phosphate, sodium silcate, and potassium silicate.

The additives other than the above components include compounds such as boric acid and borax; a development inhibitor such as sodium bromide, potassium bromide and potassium iodide; an organic solvent such as ethylene glycol, diethylene glycol, triethylene glycol, dimethylformamide, methylcellosolve, hexylene glycol, ethanol, and methanol; an antifoggant such as a mercapto type compound including 1-phenyl-5-mercaptotetrazole and sodium 2-mercaptobenzimidazole-5-sulfonate, an indazole type compound including 5-nitroindazole, and a benzotriazole type compound including 5-methylbenzotriazole. Further, a color toning agent, a surface active agent, a deforming agent, a hard-water softening agent, and a hardener may be contained according to necessity. Particularly preferred are the amino compounds described in JP-A-56-106244 and the imidazole compounds described in JP-B-48-35493 from the viewpoint of accelerating development or increasing sensitivity.

One can use for a developing solution used with the present invention, the silver stain-preventing agents described in JP-A-56-24347 and the uneven development-preventing agents described in JP-A-62-212651, and the dissolution aids described in JP-A-61-267759.

There can be used in the developing solution of the present invention, boric acids as a buffering agent described in JP-A-62-186259, sugars (for example, sucrose) described in JP-A-60-93433, oximes (for example, acetoxime), phenols (for example, 5-sulfosalicylic acid), and tertiary phosphoric acid salts (for example, a sodium salt and a potassium salt). Among these, the boric acids are preferred.

A fixing agent is an aqueous solution containing a hardener (for example, a water soluble aluminum compound), and acetic acid and dibasic acid (for example, tartaric acid, citric acid and the salts thereof) and has preferably a pH of 3.8 or more, more preferably 4.0 to 5.5.

Preferred as a fixing agent are sodium thiosulfate and ammonium thiosulfate. Particularly preferred is ammonium thiosulfate from the viewpoint of fixing speed. The amount of the fixing agent can be arbitrarily changed. In general, it is 0.1 to about 5 mole/liter.

A water soluble aluminum salt which acts primarily as a hardener in a fixing solution is a compound which is generally known as a hardener of an acidic hardening fixing agent, and, for example, aluminum chloride, aluminum sulfate and potassium alum are available.

Tartaric acid or a derivative thereof and citric acid or a derivative thereof can be used as the above dibasic acid singly or in combination of two or more. Effective is a solution containing these compounds in an amount of preferably 0.005 mole or more, particularly preferably 0.01 to 0.03 mole, per liter of the fixing solution.

To be concrete, one can use tartaric acid, potassium tartrate, sodium tartrate, potassium sodium tartrate, ammonium tartrate, and ammonium potassium tartrate.

There can be given as the citric acid or a derivative thereof, citric acid, sodium citrate, and potassium citrate.

Further, the fixing solution can contain according to necessity, a preservative (for example, a sulfurous acid salt and a bisulfurous acid salt), a pH buffering agent (for example, acetic acid and boric acid), a pH adjusting agent (for example, ammonia and sufuric acid), an image preservation improving agent (for example, potassium iodide), and a chelating agent. The pH buffering agent is used preferably in an amount of 10 to 40 g/liter, more preferably 18 to 25 g/liter, as needed for the pH of a developing solution.

The fixing temperature and time are similar to those for development, preferably 10 seconds to 1 minute at about 20 to about 50° C.

Further, the rinsing water may contain an anti-mold agent (for example, the compounds described in *Chemistry of Anti-Funqus and Anti-Mold,* by H. Horiguchi and JP-A-62-115154), a rinsing accelerator (a sulfurous acid salt), and a chelating agent.

According to the above methods, a light-sensitive material subjected to development and fixing is rinsed and dried. Rinsing is carried out preferably at about 20 to about 50° C. for 10 seconds to 3 minutes in order to remove almost completely the silver salt dissolved by fixing. Drying is carried out at about 40 to about 100° C., and the drying time is arbitrarily changed according to surrounding conditions. Usually, it may be 5 seconds to 3 minutes and 3 seconds.

A roller transporting type automatic developing machine is described in the specifications of U.S. Pat. Nos. 3,025,779 and 3,545,971. In the present invention, it is referred to simply as a roller transport type processor. The roller transporting type processor consists of the four steps of developing, fixing, rinsing and drying. The other steps (for example, a stopping step) are not excluded from the method according to the present invention, but these four steps are most preferably employed. In the rinsing step, a 2 to 3 stage countercurrent rinsing system can be used to carry out a processing to save water.

The developing solution used in the present invention is stored preferably in a packaging material having a low oxygen permeation, as described in JP-A-61-73147. Further, a replenishing system described in JP-A-62-91939 can be preferably used for the developing solution used in the present invention.

Because the silver halide photographic material according to the present invention provides high Dmax values, where it is subjected to a reduction processing after forming an image, a high density is maintained therewith if the dot area is decreased.

The reducing solution used in the present invention is not specifically limited. There can be used the compounds described in, for example, JP-A-50-27543, JP-A-52-68429, JP-A55-17123, JP-A-55-79444, JP-A-57-10140, JP-A-57-142639, and JP-A-61-61155, in addition to those in *The Theory of the Potographic Process,* by Meads, pp. 738 to 744 (1954), published by Macmillan Co., and *Photographic Processing: Theory and Application,* by Tetsuo Yano, pp. 166 to 169 (1978), published by Kyoritsu Shuppan Co., Ltd. There are used singly or in combination as an oxidizing agent, permanganates, persulfates, ferric salts, cupric acids, secondary cerium salts, red prussiates of potash, and bichromates.

Further, there are used according to necessity, a reducing solution containing inorganic acids such as sulfuric acid, and alcohols, and a reducing solution containing an oxidizing agent such as red prussiate of potash and ferric ethylenediaminetetracetate, a silver halide solvent such as thiosulfate, rhodanide, thiourea, and the derivatives thereof, and according to necessity, inorganic acid such as sulfuric acid.

Representative examples of a reducing solution used in the present invention include a so called Farmer's reducing solution containing ferric ethylenediaminetetracetate, potassium permanganate, an ammonium persulfate reducing solution (Kodack R-5), and a secondary cerium salt reducing solution.

The temperature condition for reducing processing is generally 10 to 40° C., particularly preferably 15 to 30° C., and the reducing processing can be preferably finished within several seconds to several ten minutes, particularly preferably within several minutes. A sufficiently broad reducing width can be obtained within this condition if a light-sensitive material of the present invention is used for plate making.

A reducing solution acts on a silver image formed in an emulsion layer via a light-insensitive upper layer containing a compound of the present invention.

To be concrete, there are available various methods. There can be employed, for example, a method in which a light-sensitive material for plate making is dipped in a reducing solution to agitate the solution and a method in which a reducing solution is coated on a light-sensitive material for plate making with a brush and a roller.

The present invention will be concretely explained with reference to the examples below but is not limited thereto.

EXAMPLES

Example I-1

Preparation of emulsions

Emulsion A

A silver nitrate aqueous solution and a sodium chloride aqueous solution containing $4\times10^{31\ 5}$ mole per mole of silver of $(NH_4)_2Rh(H_2O)Cl_5$ were simultaneously added to a gelatin aqueous solution containing 5,6-cyclopentane-4-hydroxy-1,3,3a,7-tetrazaindene ($5\times10^3$ mole per mole of silver) kept at 40° C., for three and a half minutes while controlling the potential at 95 mY. Core grains having a size of 0.08 Bm were prepared. Then, a silver nitrate aqueous solution and a sodium chloride aqueous solution containing $1.2\times10^{31\ 4}$ mole per mole of silver of $(NH_4)_2Rh(H_2O)Cl_5$ of were simultaneously added for 7 minutes while controlling the potential at 95 mV, whereby cubic silver chloride grains having an average grain size of 0.10 μm were prepared.

Emulsion B

A silver nitrate aqueous solution and a sodium chloride aqueous solution containing $4\times10^5$ mole per mole of silver of $(NH_4)_2Rh\ (H_2O)\ Cl_5$ of were simultaneously added to a gelatin aqueous solution kept at 40° C., for four minutes while controlling the potential at 65 mV, whereby core grains having a size of 1.35 μm were prepared. Then, a silver nitrate aqueous solution and a sodium chloride aqueous solution containing $1.2\times10^{-4}$ mole per mole of silver of $(NH_4)_2Rh(H_2O)Cl_5$ were simultaneously added for 8 minutes while controlling the potential at 65 mV, whereby cubic silver chloride grains having an average grain size of 0.17 μm were prepared.

Emulsion C

Cubic silver chloride grains having an average grain size of 0.10 μm were prepared in the same manner as Emulsion A, except that the transition metal compound was removed.

Preparation of a coating sample

Added to the above emulsions were 5,6-cyclopentane-4- hydroxy-1,3,3a, 7-tetrazaindene ( 24 mg/m$^2$), ethyl acrylate latex having an average grain size of 0.05 μm ( 770 mg/m$^2$), the following compound ( 3 mg/m$^2$), and 2-bis(vinylsulfonylacetamide ) ethane (126 mg/m$^2$) as a hardener. The emulsions were coated on a polyester support so that the silver amount was 3.0 g/m$^2$ and the gelatin amount was 1.5 g/m$^2$.

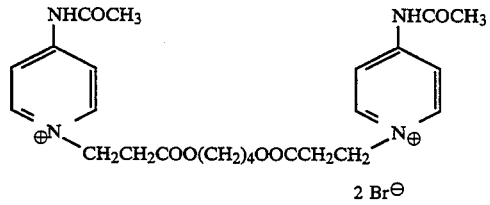

There were coated thereon as a lower protective layer, gelatin (0.8 g/m$^2$), lipoic acid (8 g/m$^2$), $C_2H_5SO_2$-SNa (6 g/m$^2$), and ethyl acrylate latex having an average particle size of 0.05 μm (230 g/m$^2$). Further, there were coated thereon as an upper protective layer, gelatin (0.7 g/m$^2$), and a dye dispersed in the form of a solid as shown in the respective tables below. At this time, there were simultaneously coated a matting agent silicon dioxide having an average particle size of 3.5 μm (55 mg/m$^2$), methanol silica having an average particle size of 0.02 μm (135 mg/m$^2$), sodium dodecylbenzenesulfonate (25 g/m$^2$) as a coating aid, a sulfuric acid ester salt of polyoxyethylene nonylphenylether having a polymerization degree of 5 (20 g/m$^2$), and potassium N-perfluoroctanesulfonyl-N-propylglycine (3 g/m$^2$), whereby the sample was prepared.

The support used in the present invention have thereon a back layer and a back protective layer each having the following composition (swelling ratio of the back layer: 110%).

| | |
|---|---|
| Back layer: | |
| Gelatin | 170 mg/m$^2$ |
| Sodium dodecylbenzenesulfonate | 32 mg/m$^2$ |
| Sodium dihexyl-α-sulfosuccinate | 35 mg/m$^2$ |
| $SnO_2$/Sb (9/1 by weight ratio, average particle size: 0.25 μm) | 318 mg/m$^2$ |
| Back protective layer: | |
| Gelatin layer | 2.7 g |
| Silicon dioxide matting agent (average particle size: 3.5 μm) | 26 mg/m$^2$ |
| Sodium dihexyl-α-sulfosuccinate | 20 mg/m$^2$ |
| Sodium dodecylbenzenesulfonate | 67 mg/m$^2$ |
| $C_8F_{17}SO_2N(C_3H_7)-(CH_2CH_2O)_n-(CH_2)_4-SO_3Li$ | 5 mg/m$^2$ |

-continued

| | | |
|---|---|---|
| Dye A | 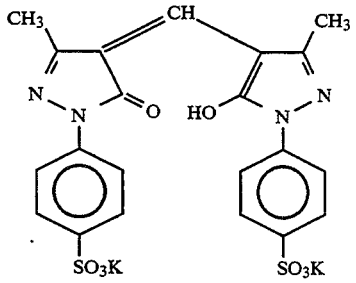 | 190 mg/m$^2$ |
| Dye B | 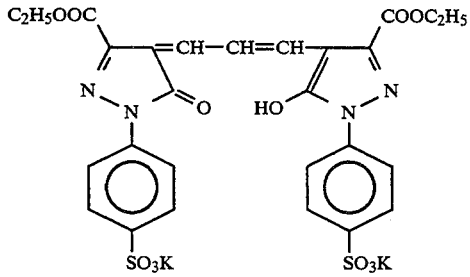 | 32 mg/m$^2$ |
| Dye C | 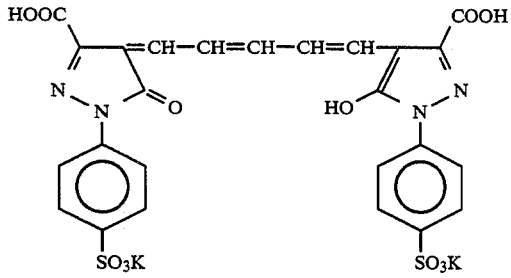 | 59 mg/m$^2$ |
| Polyethyl acrylate latex (average particle size: 0.05 μm) | | 260 mg/m$^2$ |
| 1,3-Divinylsulfonyl-2-propanol | | 149 mg/m$^2$ |

Photographic properties

The samples thus-obtained were exposed through an optical wedge with a printer P627 FM (mercury) manufactured by Dainippon Screen Co., Ltd. and then subjected to a development processing at 38° C. for 20 seconds in a developing solution LD-835 manufactured by Fuji Photo Film Co., Ltd. with an automatic processing machine FG-8008 RA, followed by fixing, rinsing and drying. These samples were evaluated for the following items:

1) Sensitivity: shown by a sensitivity relative to that of Sample No. 1, which was set at 100, wherein the sensitivity was defined by the reciprocal of an exposure giving a density of 0.1;
2) Dmax, Dmax (−1%): a film (a halftone dot original) on which a halftone dot image was formed was fixed on a base with an adhesive tape and it was tightly contacted to the respective light-sensitive material samples so that the above halftone dot original was superposed on the protective layer of the light-sensitive material face to face. Dmax and Dmax (−1%) were defined by the maximum blacking densities obtained when they were exposed so that a 50% dot area of the halftone dot original became 50% and 49% dot areas, respectively, on the light-sensitive material;
3) Gradation: calculated from the following equation: (1.5−1.0)/[log (exposure giving the density of 1.5) −log (exposure giving the density of 1.0)];
4) Safelight property: expressed by an irradiating time of an anti-fading fluorescent lamp ("FLR40SW-DL-XN U/M" manufactured by Toshiba Co., Ltd.), in which a halftone dot of originally 50% is expanded by 2% when a light-sensitive material is irradiated by the fluorescent lamp for exposure; and
5) Spreading and chalking: expressed by a line width (μm) of a line image crashed when an exposure is given in a dot to dot work of 1:1 as shown in FIG. 1 of Japanese Patent Application No. 3-96072.

TABLE I-1

| | | Dye Dispersion in the Form of Solid | | Photographic Property | | | | | |
|---|---|---|---|---|---|---|---|---|---|
| Sample No. | Emulsion | Compound | Added Amount | S* | Dmax | Dmax (−1%) | Gradation | Safelight | Spread & Chalk |
| 1 (Comp.) | A | — | — | 100 | 5.6 | 5.6 | 9.0 | 15′ | 245μ |
| 2 (Inv.) | A | III-9 | 75 mg/m$^2$ | 63 | 5.6 | 5.5 | 8.5 | 60′ or more | 215μ |
| 3 (Comp.) | B | III-9 | 75 mg/m$^2$ | 79 | 5.0 | 4.6 | 6.3 | 60′ | 210μ |

TABLE I-1-continued

| Sample No. | Emulsion | Dye Dispersion in the Form of Solid Compound | Dye Dispersion in the Form of Solid Added Amount | Photographic Property S* | Dmax | Dmax (−1%) | Gradation | Safe-light | Spread & Chalk |
|---|---|---|---|---|---|---|---|---|---|
| 4 (Comp.) | C | III-9 | 200 mg/m² | 3,200 | 4.7 | 4.2 | 4.8 | or more 5′ or less | 180μ |
| 5 (Inv.) | A | I-1 | 80 mg/m² | 63 | 5.6 | 5.5 | 8.5 | 60′ or more | 215μ |
| 6 (Comp.) | B | I-1 | 80 mg/m² | 79 | 5.0 | 4.6 | 6.3 | 60′ or more | 215μ |
| 7 (Comp.) | C | I-1 | 200 mg/m² | 3,300 | 4.7 | 4.2 | 4.8 | 5′ or less | 185μ |

*Sensitivity

As is apparent from the results of Table I-1, the samples of the present invention are silver halide light-sensitive materials having a hard foot gradation, a high Dmax and suitable spreading and chalking properties. Further, they are sufficiently capable of being handled under a bright room environment.

Example I-2

The same samples as Example I-1 were subjected to development-processing at 38° C for 20 seconds in the same manner as in Example I-1, except that the developing solution and automatic developing machine were replaced with "GR-Di" and "FG-710NH", respectively, each manufactured by Fuji Photo Film Co., Ltd. The evaluation items were the same as Example I-1.

The results are shown in Table I-2.

TABLE I-2

| Sample No. | Emulsion | Dye Dispersed in the Form of Solid Compound | Dye Dispersed in the Form of Solid Added Amount | Photographic Property S* | Dmax | Dmax (−1%) | Gradation | Safe-light | Spread & Chalk |
|---|---|---|---|---|---|---|---|---|---|
| 1 (Comp.) | A | — | — | 100 | 5.8 | 5.8 | 9.3 | 10′ | 260μ |
| 2 (Inv.) | A | III-9 | 75 mg/m² | 63 | 5.7 | 5.6 | 8.7 | 60′ | 225μ |
| 3 (Comp.) | B | III-9 | 75 mg/m² | 79 | 5.1 | 4.7 | 6.5 | or more 60′ | 220μ |
| 4 (Comp.) | C | III-9 | 200 mg/m² | 3,200 | 4.8 | 4.4 | 5.0 | or more 5′ or less | 185μ |
| 5 (Inv.) | A | I-1 | 80 mg/m² | 63 | 5.6 | 5.6 | 8.7 | 60′ | 220μ |
| 6 (Comp.) | B | I-1 | 80 mg/m² | 79 | 5.0 | 4.7 | 6.5 | or more 60′ | 220μ |
| 7 (Comp.) | C | I-1 | 200 mg/m² | 3,300 | 4.8 | 4.5 | 5.0 | or more 5′ or less | 185μ |

*Sensitivity

As is apparent from the results of Table I-2, in a hybrid processing, the samples of the present invention are silver halide light-sensitive materials having a hard foot gradation, a high Dmax and suitable spreading and chalking properties. Further, they are sufficiently capable of being handled under a bright room environment.

EXAMPLE I-3

The samples used in Example I-1 were subjected to development-processing in the same manner as in Example I-1 using an automatic developing machine "FG-710NH" manufactured by Fuji Photo Film Co., Ltd. with the developing solution of the following composition at 38° C for 15 seconds. The evaluation items were the same as Example I-1. The results are shown in Table I-3.

| Composition of a developing solution | |
|---|---|
| 1-Hydroxy-ethylidene-1,1-diphosphonic acid | 2.0 g |
| Diethylenetriaminepentacetic acid | 2.0 g |
| Sodium carbonate | 10.0 g |
| Potassium sulfite | 100.0 g |
| Potassium bromide | 10.0 g |
| Diethylene glycol | 20.0 g |
| 5-Methylbenzotriazole | 0.2 g |
| Hydroquinone | 46.0 g |
| 4-Hydroxymethyl-4-methyl-1-phenyl-3-pyrazolidone | 1.0 g |
| Sodium 2-mercaptobenzimidazole-5-sulfonate | 0.3 g |
| Water to make | 1 liter |
| pH was adjusted with potassium hydroxide and water to | 10.7 |

TABLE I-3

| Sample No. | Emulsion | Dye Dispersion in the Form of Solid Compound | Dye Dispersion in the Form of Solid Added Amount | Photographic Property S* | Dmax | Dmax (−1%) | Gradation | Safe light | Spread & Chalk |
|---|---|---|---|---|---|---|---|---|---|
| 1 (Comp.) | A | — | — | 100 | 5.6 | 5.6 | 9.1 | 15′ | 250μ |
| 2 (Inv.) | A | III-9 | 75 mg/m² | 65 | 5.6 | 5.6 | 8.6 | 60′ or more | 220μ |
| 3 (Comp.) | B | III-9 | 75 mg/m² | 80 | 5.0 | 4.6 | 6.3 | 60′ or more | 210μ |
| 4 (Comp.) | C | III-9 | 200 mg/m² | 3,200 | 4.7 | 4.2 | 4.8 | 5′ or less | 180μ |

TABLE I-3-continued

| Sample No. | Emulsion | Dye Dispersion in the Form of Solid Compound | Added Amount | Photographic Property S* | Dmax | Dmax (−1%) | Gradation | Safe light | Spread & Chalk |
|---|---|---|---|---|---|---|---|---|---|
| 5 (Inv.) | A | I-1 | 80 mg/m$^2$ | 65 | 5.6 | 5.6 | 8.6 | 60′ or more | 220μ |
| 6 (Comp.) | B | I-1 | 80 mg/m$^2$ | 80 | 5.0 | 4.6 | 6.3 | 60′ or more | 215μ |
| 7 (Comp.) | C | I-1 | 200 mg/m$^2$ | 3,300 | 4.7 | 4.2 | 4.8 | 5′ or less | 185μ |

*Sensitivity

As is apparent from the results of Table I-3, in rapid processing, the samples of the present invention are silver halide light-sensitive materials having a hard foot gradation, a high Dmax and suitable spreading and chalking properties. Further, they are sufficiently capable of being handled under a bright room environment.

Example I-4

Emulsions D, E and F were prepared at 35° C., 45° C. and 50° C., respectively, in the same manner as Emulsion A of Example I-1. The average grain sizes thereof were 0.08 μm, 0.14 μm and 0.18 μm, respectively.

Emulsions G, H, I and J were prepared in the same manner as Emulsions A, D, E and F, except that $(NH_4)_2Rh(H_2O)Cl_5$ was replaced with $K_2Ru(NO)Cl_5$. The coated samples were prepared and evaluated in the same manner as in Example I-1. The results are shown in Table I-4.

TABLE I-4

| Sample No. | Em | Average Grain Size | Transition Metal Compound | Dye Dispersed in the Form of Solid Compd. | Added Amount | Photographic Property S*1 | Dmax | Dmax*2 | G*3 | Safe-light | Spread & Chalk |
|---|---|---|---|---|---|---|---|---|---|---|---|
| 1 (Comp.) | A | 0.10 μm | $Rh(H_2O)Cl_5$ | — | — | 100 | 5.6 | 5.6 | 9.0 | 15′ | 245μ |
| 2 (Comp.) | D | 0.08 μm | $Rh(H_2O)Cl_5$ | — | — | 95 | 5.6 | 5.6 | 9.0 | 15′ | 240μ |
| 3 (Comp.) | E | 0.14 μm | $Rh(H_2O)Cl_5$ | — | — | 111 | 5.3 | 5.2 | 8.3 | 15′ | 245μ |
| 4 (Comp.) | F | 0.18 μm | $Rh(H_2O)Cl_5$ | — | — | 130 | 5.0 | 4.9 | 7.3 | 10′ | 245μ |
| 5 (Comp.) | G | 0.10 μm | $Ru(NO)Cl_5$ | — | — | 94 | 5.4 | 5.4 | 9.2 | 15′ | 230μ |
| 6 (Comp.) | H | 0.08 μm | $Ru(NO)Cl_5$ | — | — | 89 | 5.4 | 5.4 | 9.2 | 15′ | 230μ |
| 7 (Comp.) | I | 0.14 μm | $Ru(NO)Cl_5$ | — | — | 103 | 5.2 | 5.1 | 8.5 | 15′ | 225μ |
| 8 (Comp.) | J | 0.18 μm | $Ru(NO)Cl_5$ | — | — | 121 | 4.9 | 4.9 | 7.5 | 15′ | 230μ |
| 9 (Inv.) | A | 0.10 μm | $Rh(H_2O)Cl_5$ | III-9 | 75 mg/m$^2$ | 63 | 5.6 | 5.5 | 8.5 | 60′ or more | 215μ |
| 10 (Inv.) | D | 0.08 μm | $Rh(H_2O)Cl_5$ | III-9 | 75 mg/m$^2$ | 60 | 5.6 | 5.5 | 8.6 | 60′ or more | 210μ |
| 11 (Inv.) | E | 0.14 μm | $Rh(H_2O)Cl_5$ | III-9 | 75 mg/m$^2$ | 70 | 5.3 | 5.1 | 8.0 | 60′ or more | 215μ |
| 12 (Comp.) | F | 0.18 μm | $Rh(H_2O)Cl_5$ | III-9 | 75 mg/m$^2$ | 82 | 5.0 | 4.8 | 7.0 | 60′ or more | 215μ |
| 13 (Inv.) | G | 0.10 μm | $Ru(NO)Cl_5$ | III-9 | 75 mg/m$^2$ | 59 | 5.4 | 5.3 | 8.7 | 60′ or more | 210μ |
| 14 (Inv.) | H | 0.08 μm | $Ru(NO)Cl_5$ | III-9 | 75 mg/m$^2$ | 56 | 5.4 | 5.3 | 8.7 | 60′ or more | 210μ |
| 15 (Inv.) | I | 0.14 μm | $Ru(NO)Cl_5$ | III-9 | 75 mg/m$^2$ | 65 | 5.2 | 5.1 | 8.2 | 60′ or more | 215μ |
| 16 (Comp.) | J | 0.18 μm | $Ru(NO)Cl_5$ | III-9 | 75 mg/m$^2$ | 76 | 4.9 | 4.7 | 7.2 | 60′ or more | 210μ |
| 17 (Comp.) | A | 0.10 μm | $Rh(H_2O)Cl_5$ | Dye*4 | 75 mg/m$^2$ | 50 | 5.3 | 4.7 | 7.0 | 60′ or more | 100μ |

*1Sensitivity.
*2Dmax (−1%).
*3Gradation.
*4Water soluble dye.

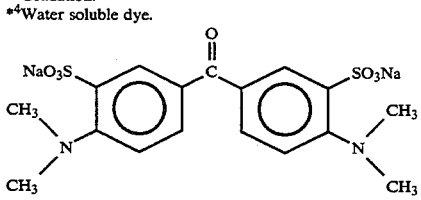

As is apparent from the results of Table I-4, the samples of the present invention containing the silver halide grains having an average grain size of 0.15 μm or less are silver halide light-sensitive materials having a hard foot gradation, a high Dmax and the suitable spreading and chalking properties. Further, they are sufficiently capable of being handled under a bright room environment.

Example II-1

Emulsion A

An emulsion was prepared in the same manner as was Emulsion A of Example I-1.

Preparation of a coating sample

The samples were prepared in the same manner as in Example I-1. Further, the back layer and back protective layer were provided in the same manner as in Example I-1.

Photographic properties

The samples thus-obtained were evaluated in the same manner as in Example I-1, except that tone reproducibility was evaluated in the following manner: expressed by a halftone dot% of reproduction which is obtained from a 2% halftone dot when the exposure necessary for obtaining a 50% reproduction from a 50% halftone dot of UGRA-Offset-Testkeil (1982) (KOHAN DENSITOGRAPH TRADING CO., LTD.) and a double exposure thereof were given. A sample having an excellent tone reproducibility has a value of 98%.

The results are shown in Table II-1.

TABLE II-1

| | | Dye Dispersed in the Form of Solid*1 | | Other Dyes | | | Photographic Property | | | | Safe- | Spread | Tone Repro-ducibility | |
|---|---|---|---|---|---|---|---|---|---|---|---|---|---|---|
| Sample No. | Em | Compd | Add*2 | Layer | Compd | Add*2 | S*3 | Dmax | Dmax*4 | G*5 | light- | & Chalk | 1:1 | x 2 |
| 1 (Comp.) | A | — | — | — | — | — | 100 | 5.6 | 5.6 | 9.0 | 15′ | 245 | 99 | 100 |
| 2 (Comp.) | A | III-9 | 75 | — | — | — | 63 | 5.6 | 5.5 | 8.5 | 60′ or more | 215 | 99 | 100 |
| 3 (Inv.) | A | III-9 | 75 | PL*6 | Dye*7 | 10 | 57 | 5.5 | 5.4 | 8.2 | 60′ or more | 200 | 98 | 99 |
| 4 (Inv.) | A | III-9 | 75 | PL | Dye*7 | 25 | 50 | 5.5 | 5.4 | 7.8 | 60′ or more | 190 | 98 | 98 |
| 5 (Comp.) | A | III-9 | 75 | PL | Dye*7 | 50 | 38 | 5.4 | 5.0 | 7.0 | 60′ or more | 100 | 98 | 98 |
| 6 (Inv.) | A | III-9 | 75 | EL*8 | III-9 | 25 | 51 | 5.5 | 5.4 | 7.8 | 60′ or more | 190 | 98 | 98 |
| 7 (Comp.) | A | I-1 | 80 | — | — | — | 63 | 5.6 | 5.5 | 8.5 | 60′ or more | 215 | 99 | 100 |
| 8 (Inv.) | A | I-1 | 80 | EL | Dye*9 | 4 | 56 | 5.5 | 5.4 | 8.2 | 60′ or more | 200 | 98 | 99 |
| 9 (Comp.) | A | I-1 | 80 | EL | Dye*9 | 20 | 35 | 5.3 | 4.9 | 6.9 | 60′ or more | 100 | 98 | 98 |

*1Added to a protective layer.
*2Added amount in terms of mg/m$^2$.
*3Sensitivity.
*4Dmax (−1%).
*5Gradation.
*6Protective layer.
*7Water Soluble Dye No. 1.
*8Emulsion layer.
*9Water Soluble Dye No. 2.

Water Soluble Dye No. 1

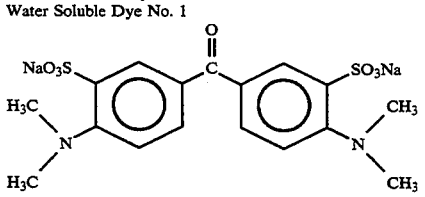

Water Soluble Dye No. 2

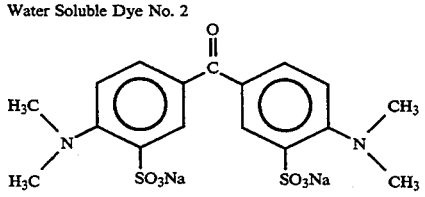

As is apparent from the results of Table II-1, the samples of the present invention are sufficiently capable of being handled under a bright room environment and have a high contrast, a high Dmax and suitable spreading and chalking properties as well as an excellent tone reproducibility in a large point which is likely to crash.

Example II-2

Emulsions D and E were prepared in the same manner as Emulsion A in Example II-1, except that the transition metal compound was replaced with $K_2Ru(NO)C_5$ and $K_2Os(NO)Cl_5$, respectively. The coating samples were prepared and evaluated in the same manner as in Example II-1. The results are shown in Table II-2.

TABLE II-2

| Sample No. | Em | Dye Dispersed in the Form of Solid*1 Compd | Add*2 | Other Dyes Layer | Compd | Add*2 | Photographic Property S*3 | Dmax | Dmax*4 | G*5 | Safe-light- | Spread & Chalk | Tone Reproducibility 1:1 | x 2 |
|---|---|---|---|---|---|---|---|---|---|---|---|---|---|---|
| 1 (Comp.) | D | — | — | — | — | — | 94 | 5.4 | 5.4 | 9.2 | 15' | 230 | 99 | 100 |
| 2 (Inv.) | D | III-9 | 75 | — | — | — | 59 | 5.4 | 5.3 | 8.7 | 60' or more | 215 | 99 | 100 |
| 3 (Inv.) | D | III-9 | 75 | EL*6 | Dye*7 | 10 | 53 | 5.4 | 5.3 | 8.4 | 60' or more | 200 | 98 | 99 |
| 4 (Comp.) | D | III-9 | 75 | EL | Dye*7 | 25 | 47 | 5.3 | 5.2 | 8.0 | 60' or more | 190 | 98 | 98 |
| 5 (Comp.) | D | III-9 | 75 | EL | Dye*7 | 50 | 36 | 5.2 | 4.9 | 7.2 | 60' or more | 100 | 98 | 98 |
| 6 (Comp.) | E | I-1 | 80 | — | — | — | 111 | 5.4 | 5.4 | 8.7 | 15' | 230 | 99 | 100 |
| 7 (Comp.) | E | I-1 | 80 | — | — | — | 70 | 5.4 | 5.4 | 8.3 | 60' or more | 215 | 99 | 100 |
| 8 (Inv.) | E | I-1 | 80 | EL | Dye*7 | 10 | 63 | 5.3 | 5.2 | 8.0 | 60' or more | 200 | 98 | 99 |
| 9 (Inv.) | E | I-1 | 80 | EL | Dye*7 | 25 | 56 | 5.3 | 5.1 | 7.8 | 60' or more | 190 | 98 | 98 |
| 10 (Comp.) | E | I-1 | 80 | EL | Dye*7 | 50 | 42 | 5.2 | 4.8 | 6.9 | 60' or more | 100 | 98 | 98 |

*1Added to a protective layer.
*2Added amount in terms of $mg/m^2$.
*3Sensitivity.
*4Dmax (−1%).
*5Gradation.
*6Emulsion layer.
*7Water Soluble Dye No. 1.

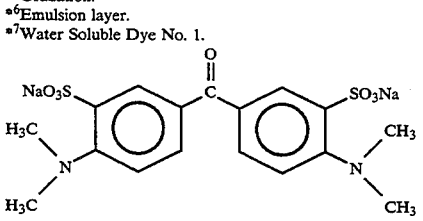

As is apparent from the results of Table II-2, the samples of the present invention are sufficiently capable of being handled under a bright room environment and have a high contrast, a high Dmax and suitable spreading and chalking properties as well as an excellent tone reproducibility in a large point which is likely to crash.

Example II-3

The samples prepared in Examples II-1 and-II-2 were subjected to development processing with an automatic developing machine FG-710NH manufactured by Fuji Photo Film Co., Ltd at 38° C for 15 seconds, except that the composition of the developing solution was changed as follows. The same evaluation as in Example II-1 and II-2 was carried out. As a result, in samples of the present invention, the spreading and chalking aptitudes and tone reproducibility were compatible and a high contrast and a high Dmax were obtained.

| Composition of developing solution | |
|---|---|
| 1-Hydroxy-ethylidene-1,1-diphosphonic acid | 2.0 g |
| Diethylenetriaminepentacetic acid | 2.0 g |
| Sodium carbonate | 10.0 g |
| Potassium sulfite | 100.0 g |
| Potassium bromide | 10.0 g |
| Diethylene glycol | 20.0 g |
| 5-Methylbenzotriazole | 0.2 g |
| Hydroquinone | 46.0 g |
| 4-Hydroxymethyl-4-methyl-1-phenyl-3-pyrazolidone | 1.0 g |
| Sodium 2-mercaptobenzimidazole-5-sulfonate | 0.3 g |
| Potassium hydroxide and water were added to Water to make | 1 liter |
| pH was adjusted with potassium hydroxide and water to | 10.7 |

Effects of the present invention

With the present invention, Dmax and gradation values can be increased while providing suitable spreading and chalking properties with a light-sensitive material handled in a bright room by using a dye dispersed in the form of solid, high silver chloride content ultra fine grains, and a transition metal coordination complex.

Further, the compatibility of suitable spreading and chalking properties with tone reproducibility has particularly been possible by fixing the dye dispersed in the form of solid in a protective layer and further applying the dye dispersed in the form of solid and/or water soluble dye to an emulsion layer (the water soluble dye may be added to a protective layer) for the purpose of preventing irradiation.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer and having provided thereon farther from the support than the emulsion layer a light-insensitive hydrophilic colloid layer comprising a solid dye which is dispersed in the form of fine particles, wherein silver halide grains contained in the light-sensitive emulsion layer have an average grain size of 0.15 μm or less and a silver chloride content of 70% mole% or more and contain therein at least $1\times10^{-7}$ mole per mole of silver of a transition metal selected from the elements of groups V to VIII of the Periodic Table.

2. The silver halide photographic material as in claim 1, wherein said light-sensitive silver halide emulsion layer contains at last one of the water soluble dye and solid dye dispersed in the form of fine particles to the extent that deterioration of sensitivity does not exceed 0.20 in terms of log E.

3. The silver halide photographic material as in claim 1, wherein said light-insensitive hydrophilic colloid layer further contains a water soluble dye.

4. The silver halide photographic material as in claim 2, wherein said solid dye which is dispersed in the form of fine particles is added to said light-insensitive hydrophilic colloid layer in an amount of 10 to 500 mg per $m^2$of the photographic material.

5. The silver halide photographic material as in claim 3, wherein at least one of the water soluble dye and the solid dye dispersed in the form of fine particles is added to said emulsion layer in a coated amount of 5 to 100 mg per $m^2$ of the photographic material.

* * * * *